US008307479B2

(12) United States Patent
Wu

(10) Patent No.: US 8,307,479 B2
(45) Date of Patent: Nov. 13, 2012

(54) HOSPITAL BED

(76) Inventor: Shiou-Jhen Wu, Banciao (TW)

( * ) Notice: Subject to any disclaimer, the term of this patent is extended or adjusted under 35 U.S.C. 154(b) by 220 days.

(21) Appl. No.: 12/854,448

(22) Filed: Aug. 11, 2010

(65) Prior Publication Data

US 2012/0036639 A1 Feb. 16, 2012

(51) Int. Cl.
*A47B 7/02* (2006.01)

(52) U.S. Cl. ..... 5/617; 5/618; 5/600; 5/613

(58) Field of Classification Search ..... 5/618, 613, 5/616, 617
See application file for complete search history.

(56) References Cited

U.S. PATENT DOCUMENTS 6,363,556 B1 * 4/2002 Krauska et al. ..... 5/618
6,839,926 B2 * 1/2005 Heimbrock et al. ..... 5/618
7,318,625 B2 * 1/2008 Roither ..... 5/618
2004/0103476 A1 * 6/2004 Barcesat ..... 5/618
2007/0234482 A1 * 10/2007 Wright ..... 5/618
2011/0231997 A1 * 9/2011 Turner et al. ..... 5/618

FOREIGN PATENT DOCUMENTS

EP 1153902 A2 * 11/2001

* cited by examiner

*Primary Examiner* — Robert G Santos
*Assistant Examiner* — Brittany Wilson

(57) ABSTRACT

A hospital bed includes a frame including connected first and second sections, a head plate connected to the first section of the frame, a tail plate connected to the second section of the frame, a first lifting unit for lifting and lowering the first section of the frame relative to the head plate, a second lifting unit for lifting and lowering the second section of the frame relative to the tail plate, an axle connected to the first lifting unit, a crank connected to the second lifting unit, a hanger for hanging the axle to the frame, and a gear assembly for connecting the axle to the crank so that the crank is operable to spin the axle to actuate the first and second lifting units.

7 Claims, 7 Drawing Sheets

HOSPITAL BED

BACKGROUND OF INVENTION

1. Field of Invention

The present invention relates to a hospital bed and, more particularly, to a hospital bed including head and tail modules that can be replaced with each other and an axle retained on at least one of the head and tail modules.

2. Related Prior Art

A conventional hospital bed includes a mattress supported on a grid connected to a frame located between and supported on head and tail plates. The grid includes various sections. At least some of the sections of the grid can be tilted. The frame includes first and second sections connected to each other. The head plate and the first section of the frame can together be called the "head module." A first lifting unit is provided between the first section of the frame and the head plate. The tail plate and the second section of the frame can together be called the "tail module." A second lifting unit is provided between the second section of the frame and the tail plate. An axle is connected to the first and second lifting units. A crank is connected to the axle. By operating the crank, the frame is lifted or lowered. At least two problems have been encountered in the use of the hospital bed. Firstly, when the hospital bed is dismantled for transportation, the axle might easily be lost because it is disconnected from the first and second lifting units and because it is not connected to the frame in the first place. Secondly, the head and tail modules cannot be replaced with each other. Should two head modules of two broken hospital beds be connected to each other, the first section of the frame of one of the hospital beds would be lifted and the first section of the frame of the other hospital bed would be lowered.

The present invention is therefore intended to obviate or at least alleviate the problems encountered in prior art.

SUMMARY OF INVENTION

It is an objective of the present invention to provide a hospital bed with head and tail modules that can be replaced with each other.

It is another objective of the present invention to provide a hospital bed with an axle retained on at least one of the head and tail modules.

To achieve the foregoing objectives, the hospital bed includes a frame, a head plate, a tail plate, a first lifting unit, a second lifting unit, an axle, a crank, a hanger and a gear assembly. The frame includes connected first and second sections. The head plate is connected to the first section of the frame so that they form the head module. The tail plate connected to the second section of the frame so that they form the tail module. The first lifting unit is operable for lifting and lowering the first section of the frame relative to the head plate. The second lifting unit is operable for lifting and lowering the second section of the frame relative to the tail plate. The axle is connected to the first lifting unit. The crank is connected to the second lifting unit. The hanger hangs the axle to the frame. The gear assembly connects the axle to the crank so that the crank is operable to spin the axle to actuate the first and second lifting units.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
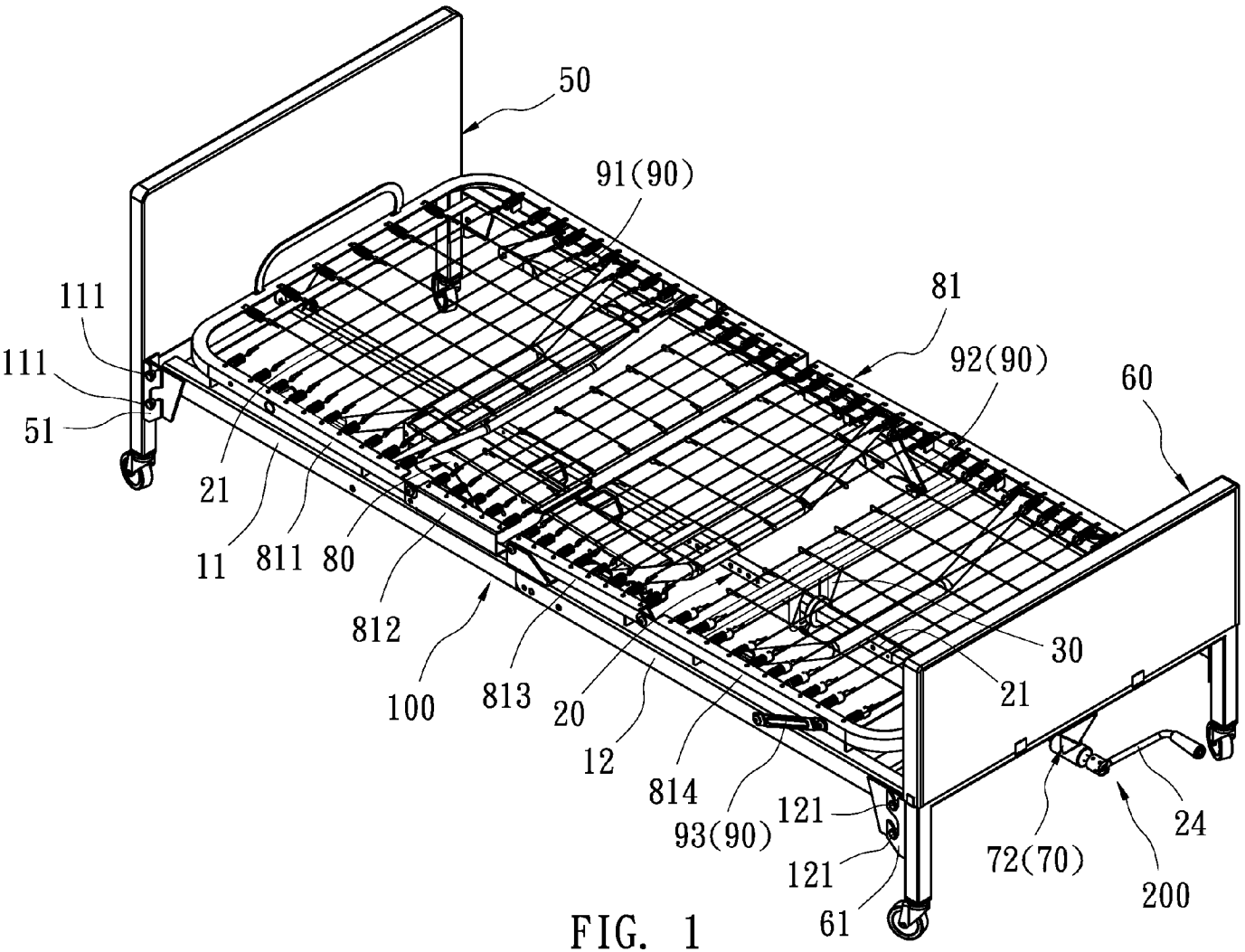
FIG. 1 is a perspective view of a hospital bed including head and tail modules according to the preferred embodiment of the present invention.
Figure 2:
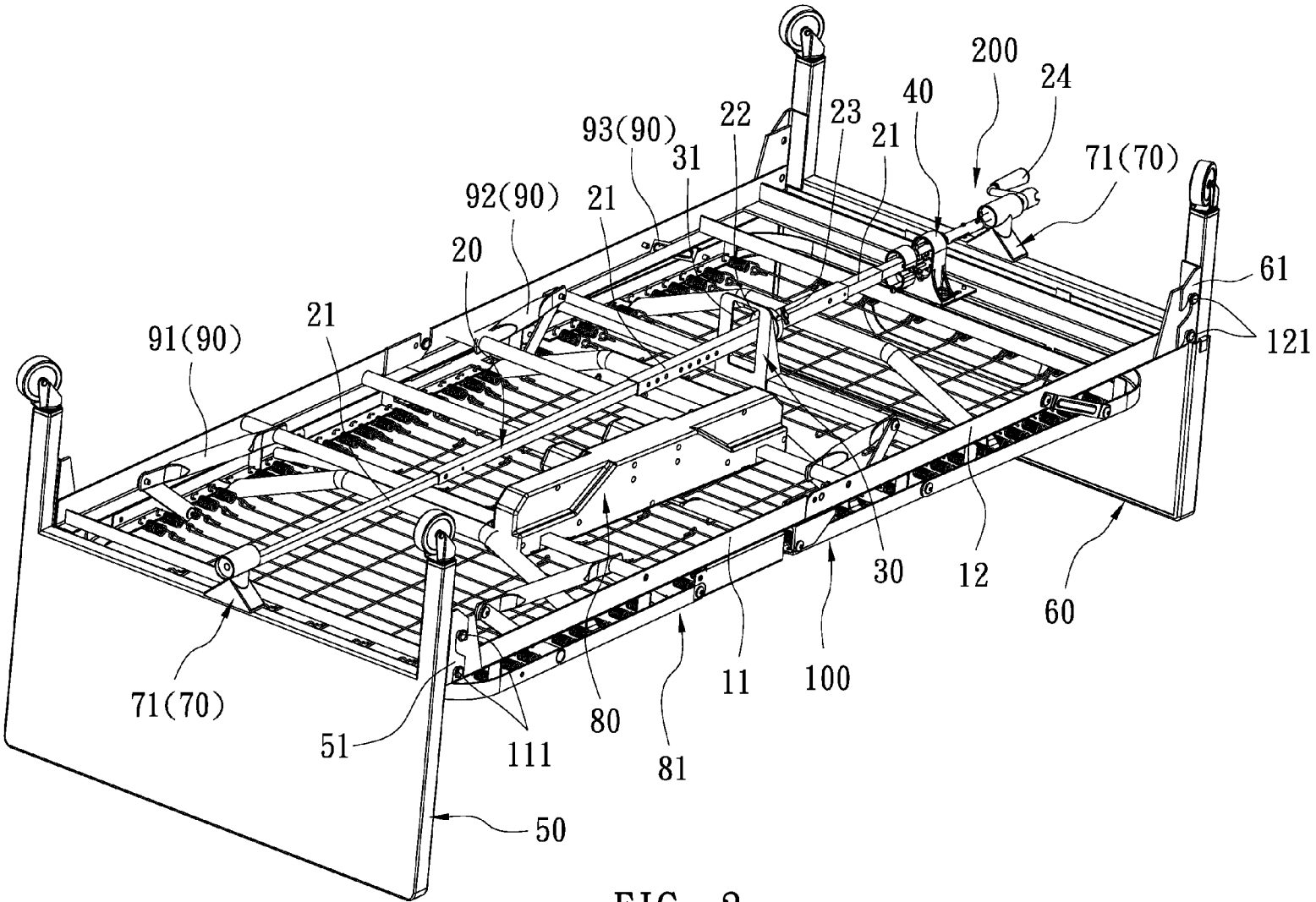
FIG. 2 is another perspective view of the hospital bed shown in FIG. 1.

Referring to FIGS. 1 and 2, a hospital bed includes a grid 81, a frame 100, a tilting device 80, a head plate 50, a tail plate 60, a lifting device 70 and an axle assembly 200 according to the preferred embodiment of the present invention. The grid 81 can support a mattress. The grid 81 includes four sections 811, 812, 813 and 814.

The frame 100 supports the grid 81. The frame 100 includes a first section 11 and a rear section 12 connected to the first section 11. The tilting device 80 is operable to tilt at least some of the sections 811 to 814 of the grid 81 relative to the frame 100. The plates 50 and 60 support the frame 100.

The lifting device 70 includes first and second lifting units 71 and 72. The first lifting unit 71 is operable to change the elevation of the first section 11 of the frame 100 relative to the head plate 50. The second lifting unit 72 is operable to change the elevation of the second section 12 of the frame 100 relative to the tail plate 60. The lifting units 71 and 72 will not be described in detail for being conventional.

The head plate 50 and the first section 11 of the frame 100 can together be called the "head module." The tail plate 60 and the second section 12 of the frame 100 can together be called the "tail module."

The axle assembly 200 interconnects the lifting units 71 and 72. The axle assembly 200 is operable to actuate the lifting units 71 and 72 to change the elevation of the sections 11 and 12 of the frame 100 relative to the plates 50 and 60, respectively.

Figure 3:
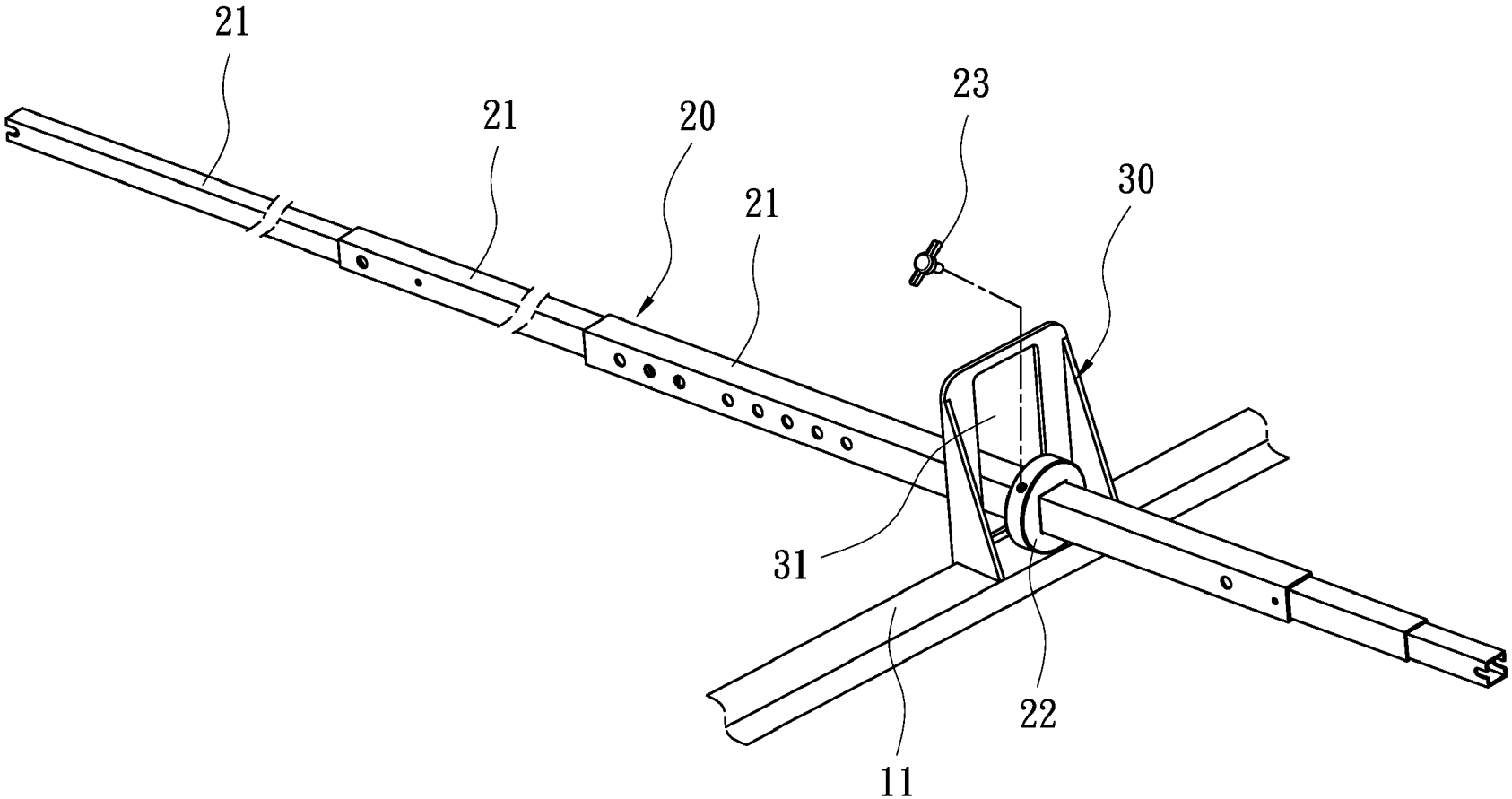
FIG. 3 is a partial view of the hospital bed shown in FIG. 2.
Figure 4:
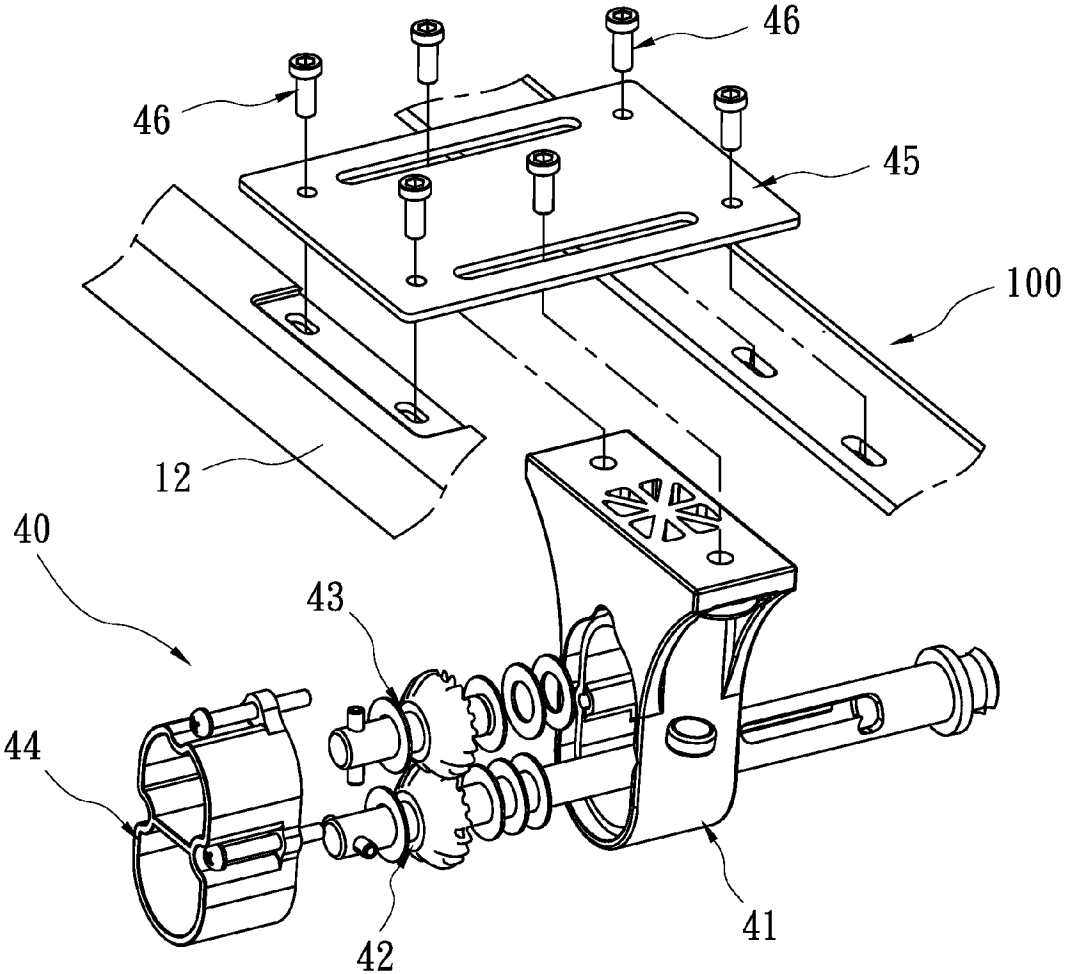
FIG. 4 is a partial view of the hospital bed shown in FIG. 1.

Further referring to FIGS. 3 and 4, the axle assembly 200 includes an axle 20, a hanger 30, a gear unit 40 and a crank 24. The axle 20 includes several tubes 21, a ring 22 and a screw 23. The tubes 21 are connected to one another telescopically. The screw 23 is driven into the tubes 21 through the ring 22, thus retaining the axle 20 in an extended or shrunk position. The crank 24 is pivotally connected to one of the tubes 21. The crank 24 is operable to spin the axle 20.

In FIGS. 2 and 3, the hospital bed is in inverted. The hanger 30 is attached to a lower face of the second section 12 of the frame 100. The hanger 30 includes an opening 31 defined therein. The axle 20 is inserted through the opening 31. The axle 20 is always connected to the frame 100 because of the hanger 30.

The gear assembly 40 is attached to the lower face of the frame 100. The gear assembly 40 includes a board 45, a cage 41, two gears 42 and 43 and a cover 44. The board 45 is connected to the second section 12 of the frame 100 by screws 46. The cage 41 is connected to the board 45 by other screws 46. The gears 42 and 43 are rotationally located in the cage 41. The gear 42 is engaged with the gear 43 so that they spin in different directions. The cover 44 keeps the gears 42 and 43 in the cage 41.

The head plate 50 is detachably connected to the first section 11 of the frame 100. The head plate 50 preferably includes two hooks 51 secured thereto by welding. Accordingly, the first section 11 of the frame 100 includes two buttons 111 secured thereto. The hooks 51 can be engaged with the buttons 111.

The tail plate 60 is detachably connected to the second section 12 of the frame 100. The tail plate 60 preferably includes two hooks 61 secured thereto by welding. Accordingly, the second section 12 of the frame 100 includes two buttons 121 secured thereto. The hooks 61 can be engaged with the buttons 121.

Figure 5:
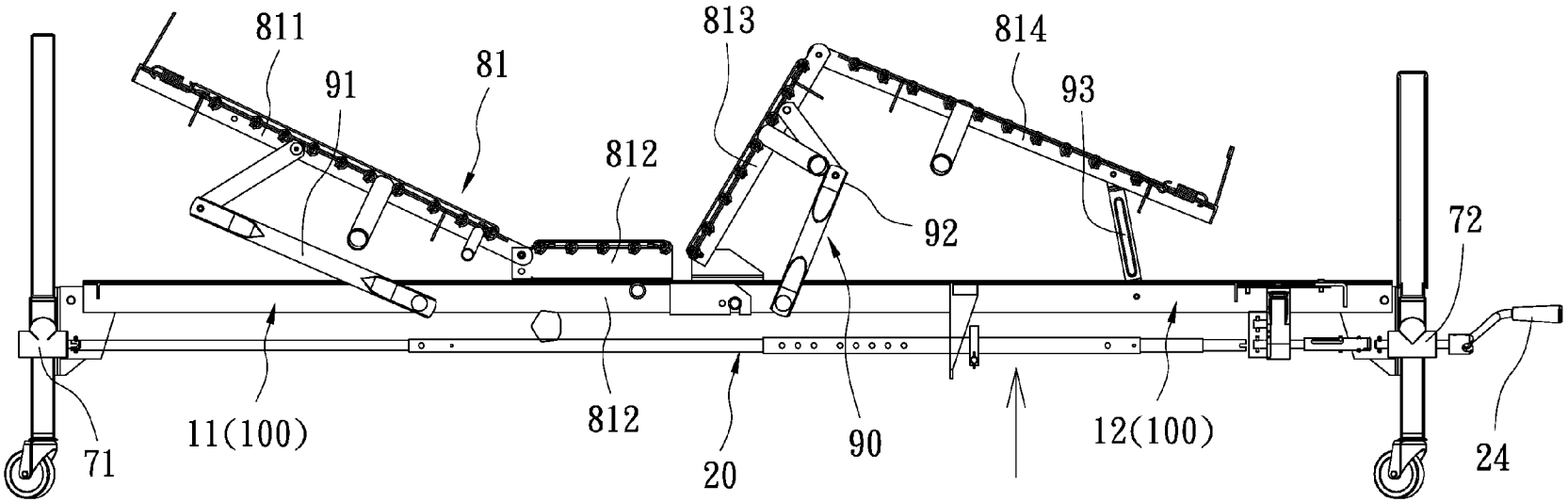
FIG. 5 is a side view of the hospital bed shown in FIG. 1.

Further referring to FIG. 5, the grid 81 is connected to the frame 100 by a linkage 90 including two rods 91, two rods 92 and a rod 93. The section 812 of the grid 81 is attached to the first section 11 of the frame 100. The section 811 of the grid 81 is pivotally connected to the section 812 of the grid 81. The section 811 of the grid 81 is pivotally connected to the first section 11 of the frame 100 by the rods 91. The section 813 of the grid 81 is pivotally connected to the second section 12 of the frame 100 by the rods 92. The section 814 of the grid 81 is pivotally connected to the second section 12 of the frame 100 by the rod 93. The tilting device 80 is operable to tilt the sections 811, 813 and 814 of the grid 81 relative to the frame 100 through the linkage 90. The tilting device 80, the grid 81 and the linkage 90 will not be described in detail for being conventional.

A first end of the axle 20 is connected to the first lifting unit 71 while the crank 24 is connected to the second lifting unit 72. Normally, a second end of the axle 20 is connected to the gear 42, and the second lifting unit 72 is connected to the gear 42 through a shaft. The crank 24 is operated to spin the lifting units 71 and 72 in a same direction. Thus, both of the sections 11 and 12 of the frame 100 are synchronously lifted or lowered.

Figure 6:
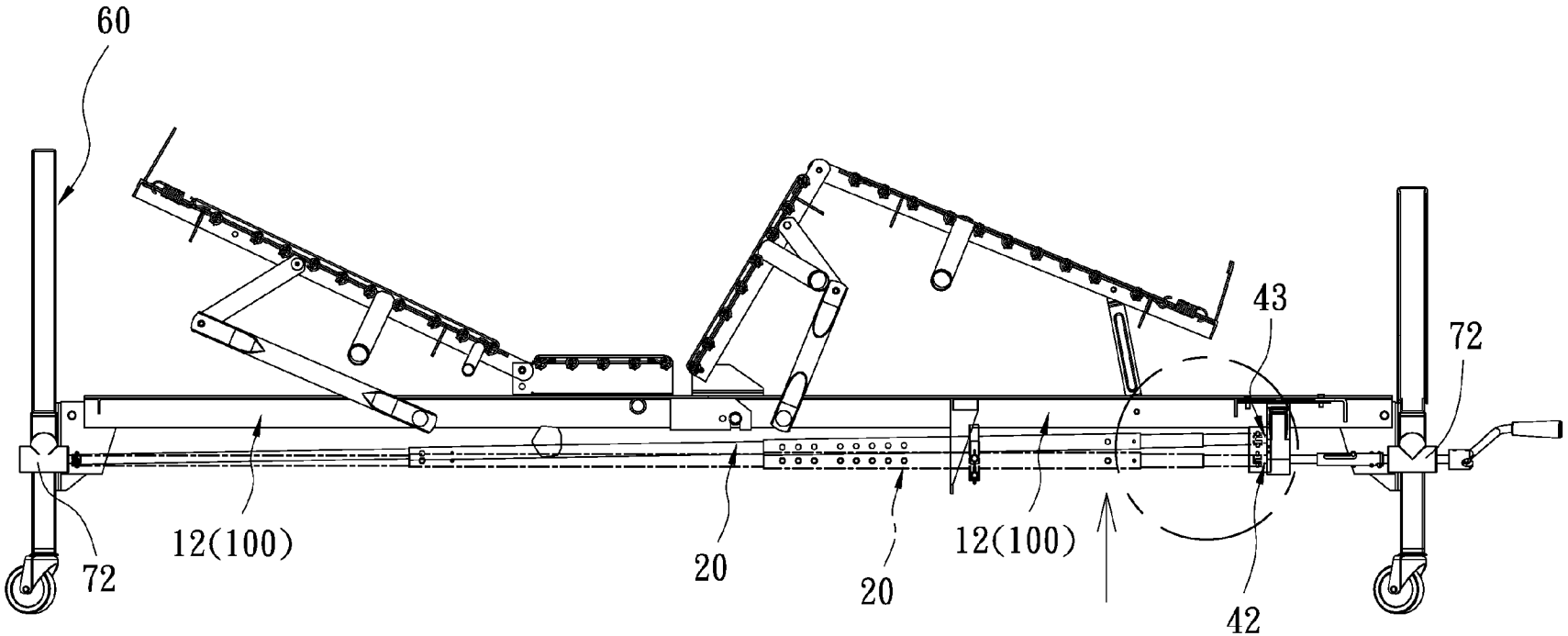
FIG. 6 is a side view of a hospital bed including two tail modules shown in FIG. 1.
Figure 7:
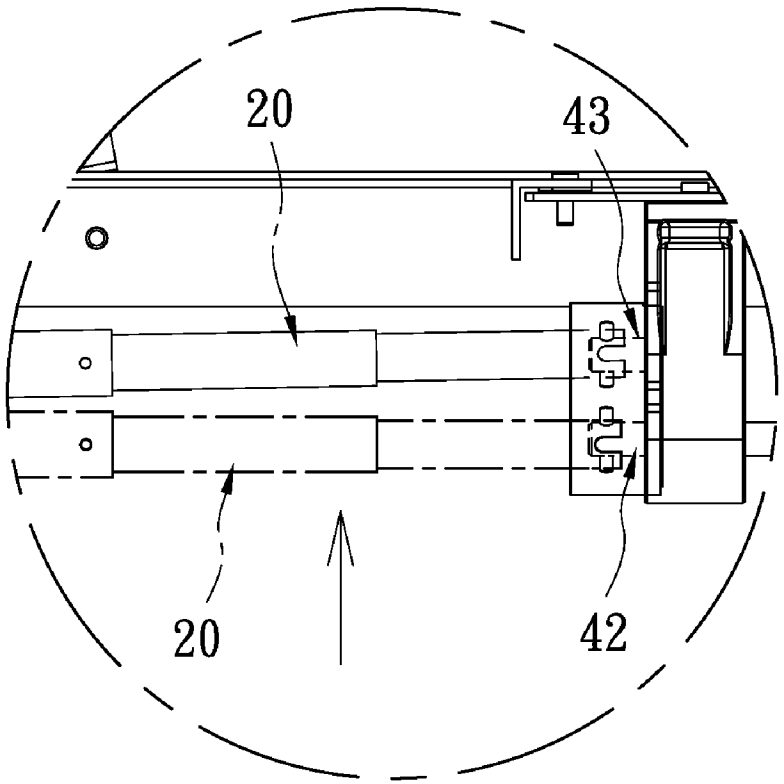
FIG. 7 is a partial view of the hospital bed shown in FIG. 6.

Referring to FIGS. 6 and 7, two hospital beds are broken, and the second sections 12 of the frames 100 thereof are connected to each other to make a used but workable hospital bed. Hence, one of the second lifting units 72 is reversed, and so is one of the tail plates 60. The first end of the axle 20 is connected to the second lifting unit 72 attached to the reversed tail plate 60, and the crank 24 is connected to the second lifting unit 72 attached to the normally positioned tail plate 60. The second end of the axle 20 is connected to the gear 43 while the second lifting unit 72 is connected to the gear 42. The crank 24 is operated to spin the lifting units 72 in different directions. Thus, both of the second sections 12 of the frame 100 of the broken hospital beds are synchronously lifted or lowered.

The hospital bed of the present invention exhibits several advantages over the conventional hospital bed addressed in the Related Prior Art. At first, the axle 20 is always connected to the frame 100 because of the hanger 30. Secondly, two rear sections 12 (or front sections 11) of the frames 100 of two broken hospital beds can be connected to each other to make a used but workable hospital bed.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A hospital bed including:

a frame including a first section and a second section connected to the first section;

a head plate connected to the first section of the frame;

a tail plate connected to the second section of the frame;

a first lifting unit for lifting and lowering the first section of the frame relative to the head plate;

a second lifting unit for lifting and lowering the second section of the frame relative to the tail plate;

an axle connected to the first lifting unit;

a crank connected to the second lifting unit;

a hanger for hanging the axle to a lower face of the frame; and a gear assembly for connecting the axle to the crank so that the crank is operable to spin the axle to actuate the first and second lifting units, wherein the gear assembly includes:

a cage attached to the frame;

major and minor gears engaged with each other in the cage, wherein the major gear is connected to the second lifting unit while a selected one of the major and minor gears is connected to the axle; and a cover for retaining the major and minor gears in the cage.

2. The hospital bed according to claim 1, wherein the hanger includes an opening through which the axle extends.

3. The hospital bed according to claim 1, wherein the gear assembly includes a board attached to the frame by screws, wherein the cage is attached to the board by other screws.

4. The hospital bed according to claim 1, including a grid for supporting a mattress, wherein the grid is supported on the frame.

5. The hospital bed according to claim 4, including a tilting device for tilting the grid relative to the frame.

6. The hospital bed according to claim 5, including a linkage through which the tilting device tilts the grid relative to the frame.

7. The hospital bed according to claim 1, wherein the axle including tubes connected to one another telescopically.

* * * * *